US007076906B2

(12) United States Patent
Monks et al.

(10) Patent No.: US 7,076,906 B2
(45) Date of Patent: Jul. 18, 2006

(54) ELECTRONIC GRIP-FRAME FOR A PAINTBALL MARKER

(75) Inventors: Steven John Monks, Manchester (GB); Jack Kingsley Wood, Cheshire (GB)

(73) Assignee: Planet Eclipse Limited, Manchester (GB)

( * ) Notice: Subject to any disclaimer, the term of this patent is extended or adjusted under 35 U.S.C. 154(b) by 0 days.

(21) Appl. No.: 10/604,444

(22) Filed: Jul. 22, 2003

(65) Prior Publication Data

US 2004/0200115 A1 Oct. 14, 2004

(30) Foreign Application Priority Data

Jul. 24, 2002 (GB) ..... 0217099.1

(51) Int. Cl.
*F41A 19/00* (2006.01)

(52) U.S. Cl. ..... 42/84; 89/28.05; 89/28.1; 124/31

(58) Field of Classification Search ..... 89/28.05, 89/135, 28.1; 42/84; 362/110, 112, 111, 362/113, 114; 463/2, 37; 124/31
See application file for complete search history.

(56) References Cited

U.S. PATENT DOCUMENTS 4,298,914 A 11/1981 Long ..... 362/112
4,757,629 A * 7/1988 Austin ..... 42/84
4,793,085 A * 12/1988 Surawski et al. ..... 42/84
5,133,030 A * 7/1992 Lee ..... 385/19
5,388,749 A 2/1995 Davignon et al. ..... 227/67
5,515,838 A * 5/1996 Anderson ..... 124/76
5,727,538 A * 3/1998 Ellis ..... 124/77
5,853,324 A * 12/1998 Kami et al. ..... 463/2
5,896,691 A * 4/1999 Kaminski et al. ..... 42/70.11
5,924,231 A * 7/1999 Kidd ..... 42/69.03
5,947,738 A * 9/1999 Muehle et al. ..... 434/16
6,109,252 A * 8/2000 Stevens ..... 124/51.1
6,138,656 A 10/2000 Rice et al. ..... 124/73
6,142,137 A * 11/2000 MacLaughlin ..... 124/72
6,171,190 B1 * 1/2001 Thanasack et al. ..... 463/51
6,286,240 B1 * 9/2001 Collins ..... 42/70.08
6,287,198 B1 9/2001 McCauley ..... 463/37
6,302,092 B1 * 10/2001 Juan ..... 124/31
6,349,711 B1 * 2/2002 Perry et al. ..... 124/73
6,354,033 B1 3/2002 Findley ..... 42/84
6,360,736 B1 * 3/2002 Juan ..... 124/77
6,474,326 B1 * 11/2002 Smith et al. ..... 124/77
6,516,791 B1 * 2/2003 Perrone ..... 124/77
6,565,438 B1 * 5/2003 Ogino ..... 463/37
6,568,381 B1 * 5/2003 Chang ..... 124/32

(Continued)

FOREIGN PATENT DOCUMENTS

EP 0 276 843 A2 1/1988

(Continued)

*Primary Examiner*—M. Clement
(74) *Attorney, Agent, or Firm*—Barlow, Josephs & Holmes, Ltd.

(57) ABSTRACT

20 A grip frame 21 replaces an existing grip frame 1 on a paintball marker in order to convert said paintball marker from a mechanically operated paintball marker into an electro-pneumatic paintball marker. The electronic grip frame 21 utilizes an optical sensor in order to detect the operation of a trigger 29 and a second optical sensor to detect the presence of objects within the breech of the paintball marker. Electrical signals from these sensors are taken to an electronic circuit board 24, which controls the operation of two solenoids (one shown 26) in order to fire and recock the paintball marker. A user interface comprising pushbuttons 12, 13, 14 and a multi-character display 16, allows the user to define how the grip frame 21 functions.

7 Claims, 11 Drawing Sheets

U.S. PATENT DOCUMENTS

| | | | | |
|---|---|---|---|---|
| 6,609,511 | B1 * | 8/2003 | Kotsiopoulos et al. | 124/51.1 |
| 6,694,963 | B1 * | 2/2004 | Taylor | 124/32 |
| 6,772,548 | B1 * | 8/2004 | Power | 42/69.03 |
| 6,772,746 | B1 * | 8/2004 | Gabrel | 124/32 |
| 6,802,305 | B1 * | 10/2004 | Hatcher | 124/31 |

FOREIGN PATENT DOCUMENTS

| | | | |
|---|---|---|---|
| GB | 2269655 | A | 2/1994 |
| GB | 2342710 | A | 4/2000 |
| WO | WO 02/06754 | A2 | 1/2002 |

* cited by examiner

ELECTRONIC GRIP-FRAME FOR A PAINTBALL MARKER

CROSS REFERENCE TO RELATED APPLICATIONS

This application claims the benefit of U.K. Patent Application Serial No. 0217099.1, filed on Jul. 24, 2002.

BACKGROUND OF INVENTION

This invention relates to a grip frame. The frame is intended to form an integral part of a paintball marker and to be supplied as an upgrade for existing paintball markers.

A paintball marker, also known as a paintball gun or paintball launcher, is a device used to propel paintballs. A paintball is a spherical object typically 0.68 inch diameter, comprised of a fragile shell which encapsulates a coloured liquid. When a paintball that has been launched from a paintball marker comes into contact with a hard surface, the shell of the paintball ruptures and the coloured liquid is released, leaving a bright mark on the surface.

One type of paintball marker is a mechanically operated marker. With this type of marker the user pulls a trigger which, through the use of a mechanical linkage, releases a spring-loaded hammer. This hammer is pushed forward by the compressed spring and strikes a spring loaded valve pin, causing the valve to open for a short time and release a burst of compressed gas. This gas burst is internally diverted through the marker such that it passes through a bolt and into the breech of the marker behind a paintball. The expanding gas accelerates the paintball out of the breech, along a barrel and out of the end of that barrel. The continued pull on the trigger actuates a mechanically operated pneumatic valve, which supplies compressed gas to one side of a pneumatic cylinder. This cylinder pushes the hammer back to its starting position and also retracts the bolt to reveal a feed aperture through which a second paintball can drop into the breech. The release of the trigger switches the pneumatic valve back to its original position, supplying compressed gas to the opposite side of the pneumatic cylinder and pushing the bolt back to its original position thus causing the second paintball to be pushed into its firing position, ready for the cycle to start again.

Another type of paintball marker is an electro-pneumatic marker. This type of marker functions in much the same way as the mechanically operated marker with the exception that the trigger no longer provides the mechanical action required to operate the marker. The trigger in this type of marker operates an electrical switch, which is interpreted by an electrical circuit as the signal to start the firing cycle. This electrical circuit typically employs electro-pneumatic solenoid valves, which drive pneumatic cylinders in order to create the movement necessary to fire and re-cock the marker.

SUMMARY OF INVENTION

The electro-pneumatic paintball marker of the present invention has a much higher rate of fire than a mechanically operated paintball marker and this is a major advantage in modern paintball. The grip frame of the invention is intended for fitting onto a mechanically operated paintball marker in order to convert that marker into an electro-pneumatic marker and thus increase the rate of fire of the marker. The inventive grip frame replaces the entire grip frame of an existing paintball marker along with the hammer release mechanism and the mechanically operated pneumatic valve.

According to the present invention there is provided a grip frame for a paintball marker or the like comprising a handle, a trigger mechanism associated with the handle comprising a trigger and an electronic sensor associated with the trigger for determining when the trigger has been activated.

In a preferred embodiment of the invention, the sensor may be optical. Stop means may be provided for limiting the travel of the trigger. The stop means may comprise two adjustable stops limiting travel in opposite directions. Magnetic means may be provided to urge the trigger back to its rest position. Display means may be provided for providing information to the user disposed on that face of the handle facing the user in normal use. These display means may comprise an LED or a liquid crystal display. Advantageously, the display is a multicharacter display. Pushbuttons may be provided in the handle for calibration purposes. The frame may be made of metal or plastics or a combination of both but other materials may also be used. The invention also comprises a paintball marker including a grip frame as defined above. The marker comprises a breech and barrel connected to the grip frame. Advantageously a sensor for sensing the presence of an object in the breech is provided.

Specifically the breech sensor is used to detect the presence of objects at a position in the breech below the feed aperture through which the paintballs enter the breech. This sensor is used to detect that a paintball is in the breech before the bolt can travel forwards thus preventing the bolt from breaking a ball that has not completely passed through the feed aperture, a major problem when trying to operate other paintball markers at high rates of fire. The sensor is also used to detect that the bolt is fully forwards prior to the marker being fired, thus preventing gas from escaping the breech through the feed aperture and ensuring maximum gas efficiency.

As the trigger does not operate an electrical switch, as in the case in other paintball markers, but senses the movement of the trigger by means of a sensor, moving parts are reduced which makes the marker more reliable than other paintball markers.

The use of a magnet and adjustable screw in order to set the amount of force required to actuate the trigger is an improvement over other paintball markers where the trigger operating force can only be varied by replacing a trigger return spring.

The LED display provides improved viewing in low light conditions over the LCD displays used on other paintball markers. Mounting the display at the rear of the grip frame allows the user to view the display without having to move the paintball marker from its shooting position. This is an improvement over the other paintball markers where displays are mounted on either the side of the marker or the side of the grip frame.

Electrical elements form parts of an electronic circuit which is advantageously battery powered. The battery used to power the electronic circuit makes electrical contact with the related circuit board by means of leaf spring contacts. This is an improvement over other paintball markers which use battery straps on flying leads as these leads often break with use. Longevity for the original marker is increased by providing a means to upgrade rather than replace the marker.

BRIEF DESCRIPTION OF DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION

Figure 1:
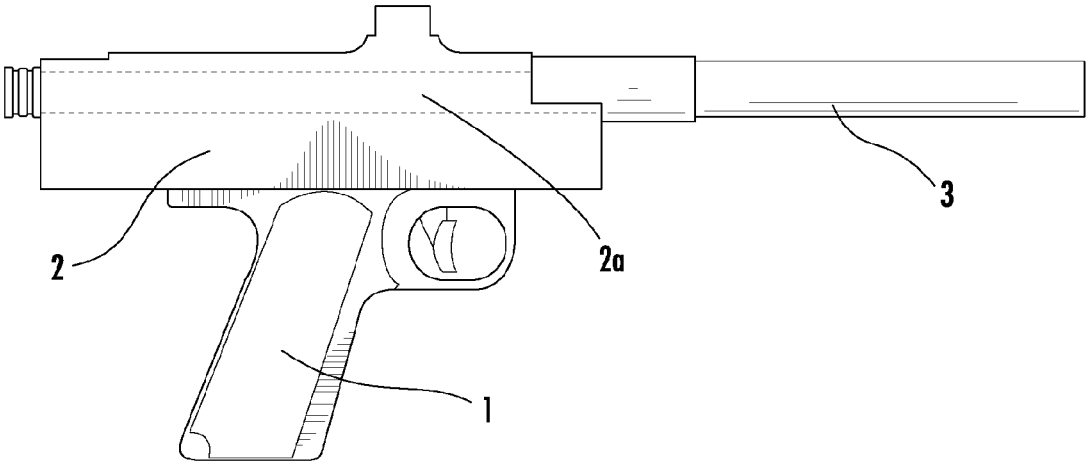
FIG. 1 shows a side elevational view of a prior art mechanically operated paintball marker.
Figure 2:
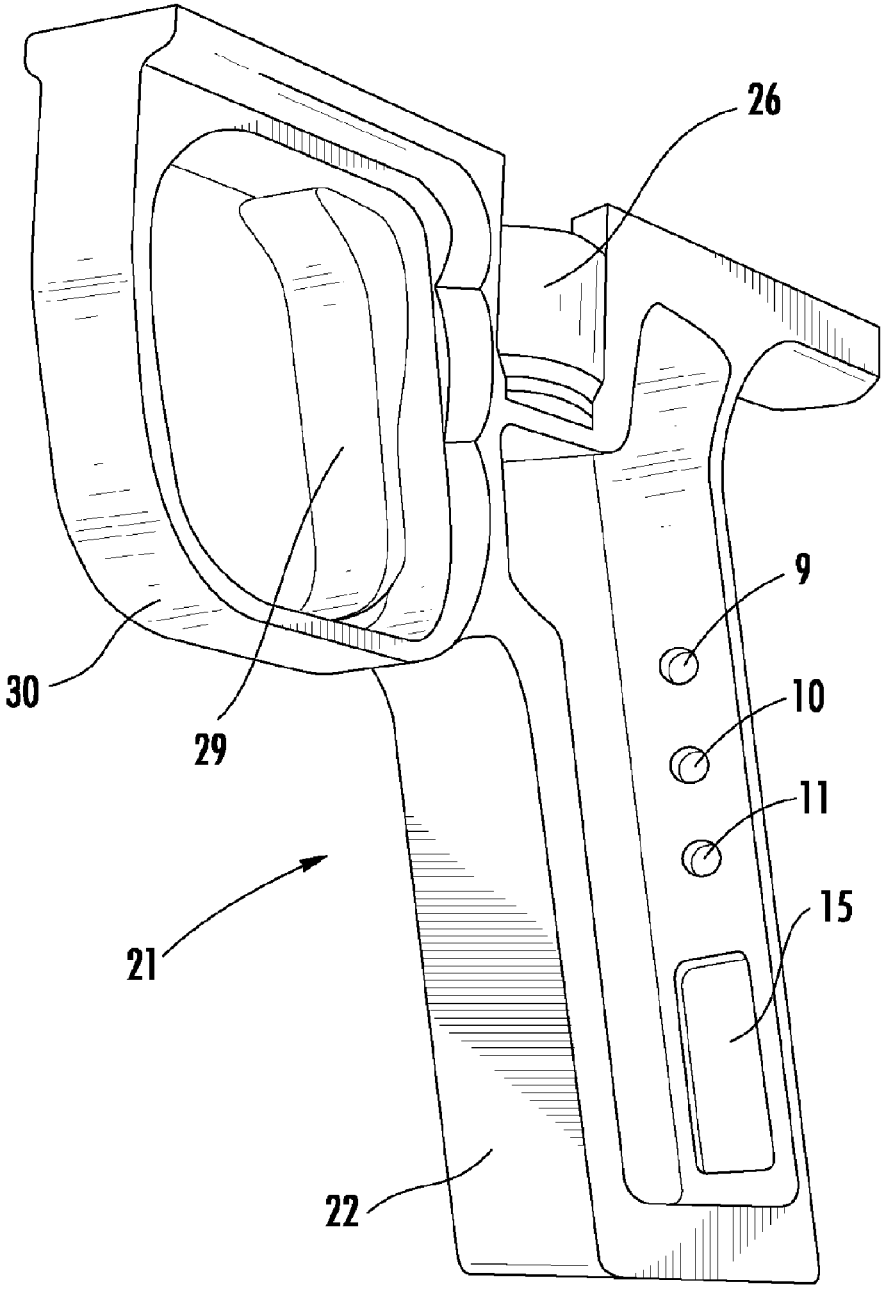
FIG. 2 shows a perspective view of an electronic grip frame of the present invention with sear solenoid in place.
Figure 3A:
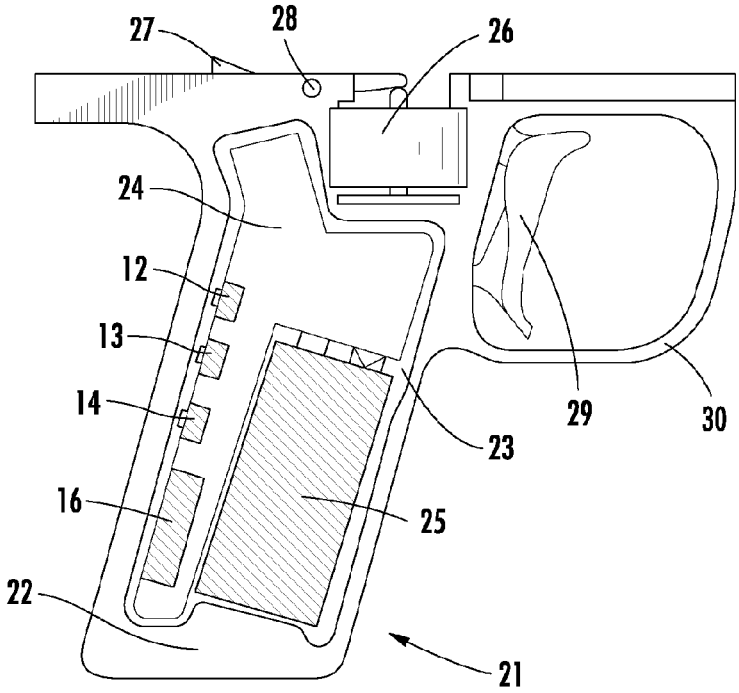
FIGS. 3*a*, 3*b* and 3*c* respectively show a side elevational view, end elevational view and plan view of the electronic grip frame of FIG. 2 with electronic circuit board and battery in place.
Figure 3B:
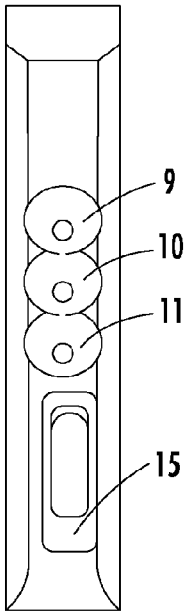
Figure 3C:
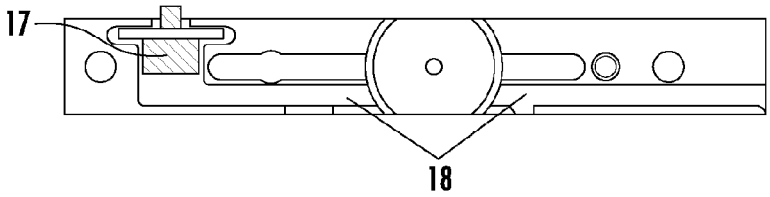

Referring to FIG. 1, the mechanically operated paintball marker comprises a grip frame 1 firing mechanism comprising body 2 defining a breech 2*a* and barrel 3. Referring to FIGS. 2, 3*a* 3*b* and 3*c*, an electronic grip frame 21 to replace the mechanical grip frame 1 is shown. Grip frame 21 comprises a handle 22 defining a cavity 23 in which an electronic circuit board 24 and an electrical battery 25 are located. Above this cavity 23 is a second cavity in which a hammer release assembly comprising a sear solenoid 26, pin 28 and sear 27 is disposed. This hammer release assembly is controlled by a trigger 29 which is protected by a trigger guard 30 to reduce the possibility of accidental operation. The hammer release assembly will be described in more detail later with reference to FIG. 6.

The trigger 29 can be operated by either one or two fingers, the trigger guard 30 being large enough to accommodate two fingered operation. At the rear of the grip frame three recessed holes 9, 10 and 11 provide access to three tactile pushbuttons 12, 13, 14 mounted on the electronic circuit board 24. This recessing prevents accidental operation of the pushbuttons. Also at the rear of the grip frame, below the pushbutton holes 9, 10 and 11 is a transparent window 15 through which can be viewed a multi-character, alphanumeric LED (light emitting diode) display 16. A slider type switch 17 is located towards the rear of the frame 21 and is used to switch the electrical supply to the electronic circuit board 24. Channels 18 are cut into the grip frame for the purpose of routing interconnecting cables.

Figure 4A:
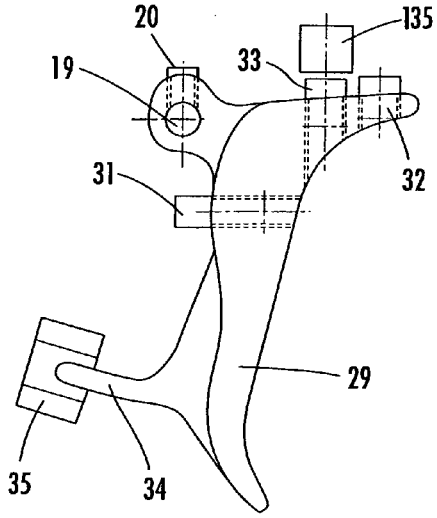
FIGS. 4*a* and 4*b* respectively show side and end elevational views of a trigger and trigger sensor forming part of the grip frame of FIG. 2.
Figure 4B:
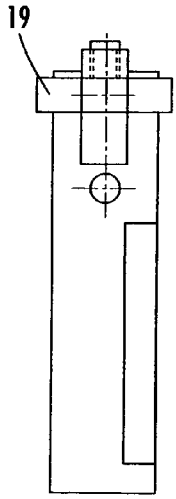
Figure 5A:
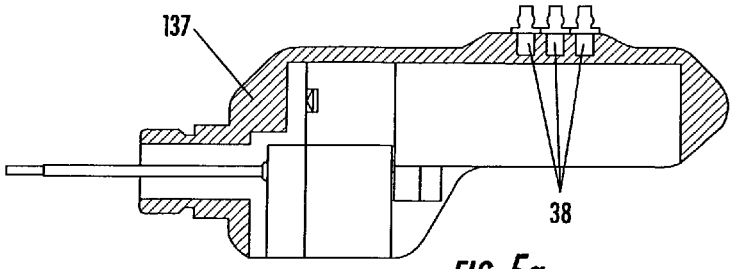
FIGS. 5*a*, 5*b*, 5*c* and 5*d* respectively show a side elevational view, underplan, plan view and end view of a cocking solenoid and protective manifold forming part of the grip frame of FIG. 2.
Figure 5B:
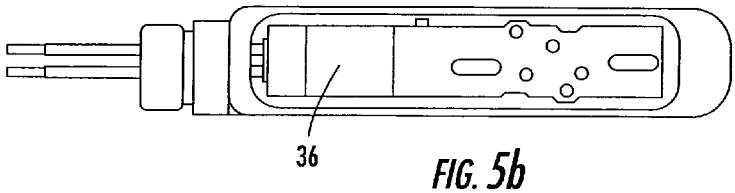
Figure 5C:
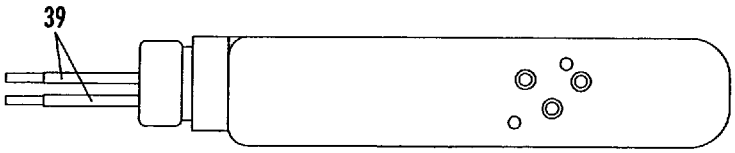
Figure 5D:
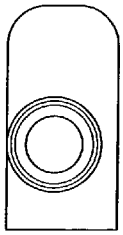

Referring to FIGS. 4*a* and 4*b*, trigger 29 pivots on a pin 19 that passes through the body of the grip frame 21. The trigger 29 is held onto the pin 19 by means of a set screw 20. A second set screw 31 locates in a threaded hole through the front of the trigger and acts as a trigger stop. This set screw 31 can be screwed into or out from the hole in order 20 to vary the maximum travel of the trigger 29. A third set screw 32 locates in a threaded hole through the top of the trigger and also acts as a trigger stop. This set screw 32 can be screwed into or out from the hole in order to vary the rest position of the trigger 29. A small magnet 135 is located in the grip frame above a fourth set screw 33. This magnet 135 attracts the set screw 33, ensuring that the trigger 29 returns to its rest position when released. A prong 34 protrudes from the -rear of the trigger 29 passing through a slot in the grip frame 21. When the trigger 29 is operated, the prong 34 passes through a slotted optical sensor 35, which is mounted on the electronic circuit board 24, causing the sensor 35 to detect that the trigger 29 has been operated.

Referring to FIGS. 5*a*, 5*b*, 5*c* and 5*d*, the cocking solenoid assembly is shown. This comprises an electro-pneumatic solenoid valve 36 mounted onto a protective manifold 137. The manifold 137 would 10 normally be attached to the front of the paintball marker in place of the existing mechanically operated valve, but it could possibly be mounted elsewhere on the marker. The manifold 137 has pneumatic connections 38 that connect to the existing pneumatics on the paintball marker. The solenoid valve 36 is electrically connected to the electronic circuit board 24 by means of insulated wire 39 and the switching of the valve 36 is controlled by the electronics on the circuit board 24.

Figure 6:
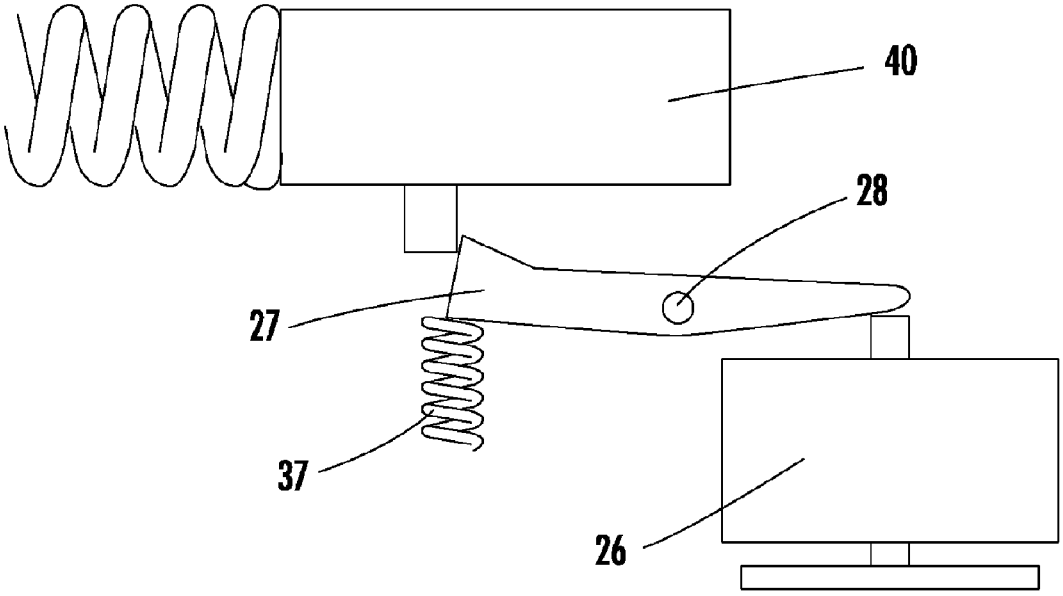
FIG. 6 diagrammatically shows a hammer release assembly for the grip frame of FIG. 2.

Referring to FIG. 6 the hammer release assembly is diagrammatically shown. This comprises the sear solenoid 26 which is an electro mechanical solenoid, which is connected to the electronic circuit board 24 and is controlled by the electronics on that board. When the sear solenoid 26 is energised it pushes onto one end of the sear 27 against the action of a sear spring 37 which pivots on pin 28 and releases a spring loaded hammer 40 located in the main body 2 of the paintball marker. When the sear solenoid 26 is de-energised both the sear 27 and the sear solenoid 26 are returned to their rest positions by the sear spring 37.

Figure 7:
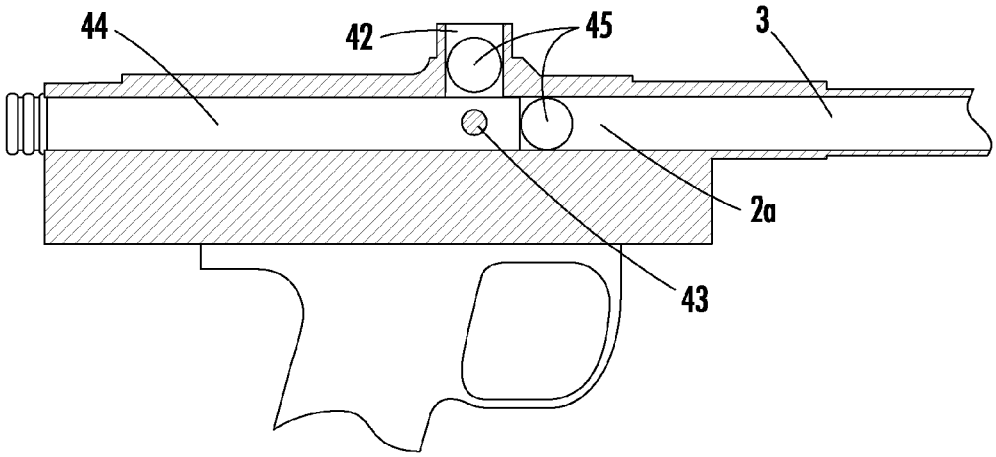
FIG. 7 shows a drawing in partial section of a paintball marker in one operative position.
Figure 8:
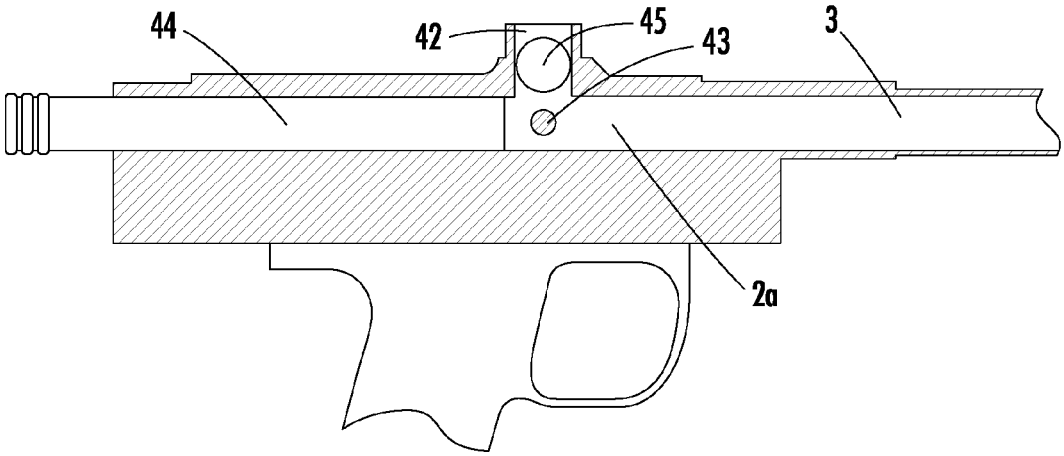
FIG. 8 shows a drawing in partial section of a paintball marker in a second operative position.
Figure 9:
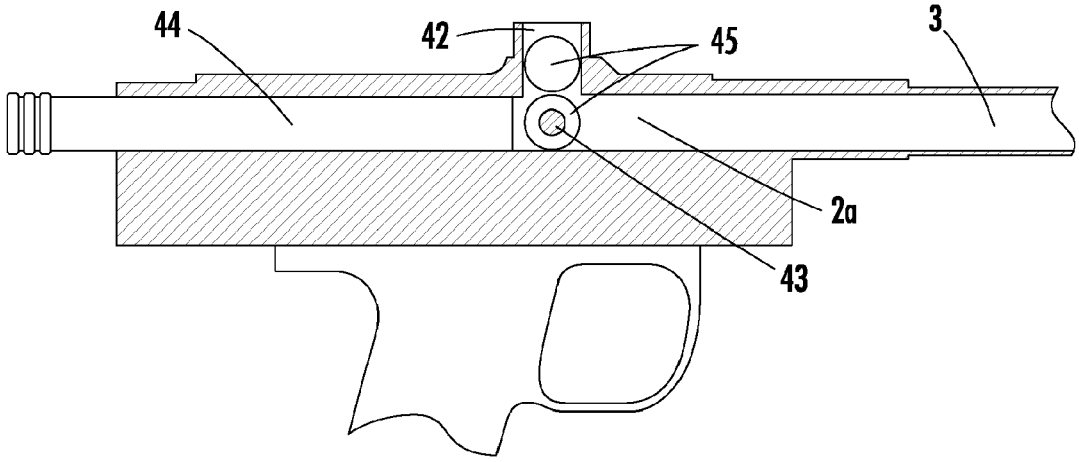
FIG. 9 shows a drawing in partial section of a paintball marker in a third operative position.

Referring to FIG. 7, a paintball feed tube 42 leads to breech 2*a*. An optical breech sensor 43 is disposed in the breech 2*a*. The firing mechanism comprises a bolt 44 which is shown in its rest position in FIG. 7 and in its cocked position in FIG. 8. In both of these Figures a paintball 45 is shown in the paintball feed tube 42 just above the breech 2*a*. In the position shown in FIG. 7, the bolt 44 prevents movement of the paintball 45 into the breech 2*a*. Cocking the bolt 44 by withdrawing it (to the left in FIG. 7 and 8) as shown in FIG. 8 permits the paintball 45 to drop from the paintball feed tube 42 into the breech 2*a* as shown in FIG. 9.

Figure 10:
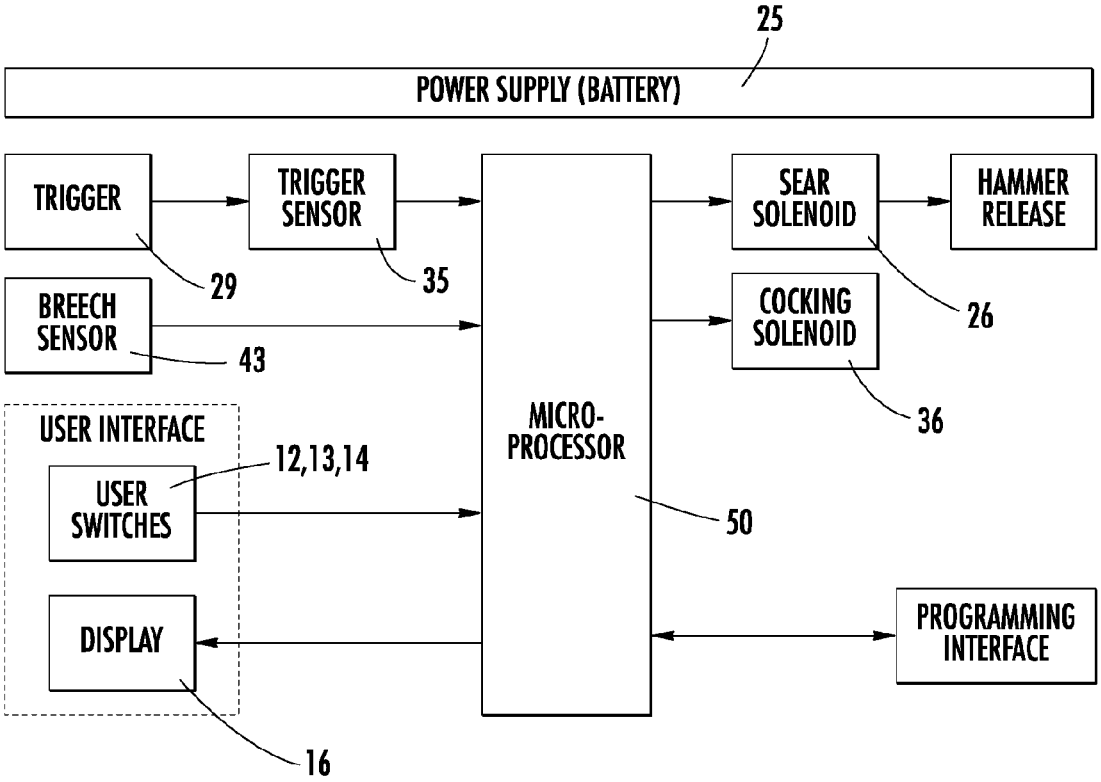
FIG. 10 shows a functional block circuit diagram for the grip frame of FIG. 2.
Figure 11A:
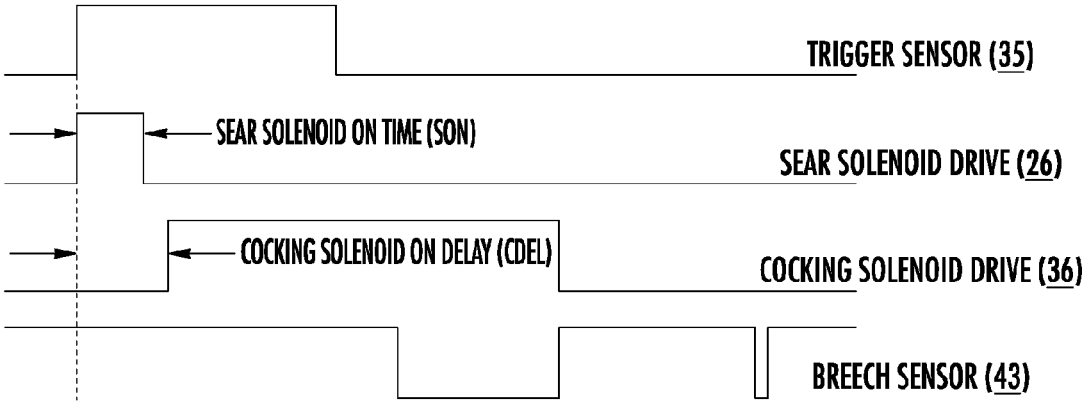
FIGS. 11*a* and 11*b* show timing diagrams for the paintball marker of FIGS. 7 to 9.
Figure 11B:
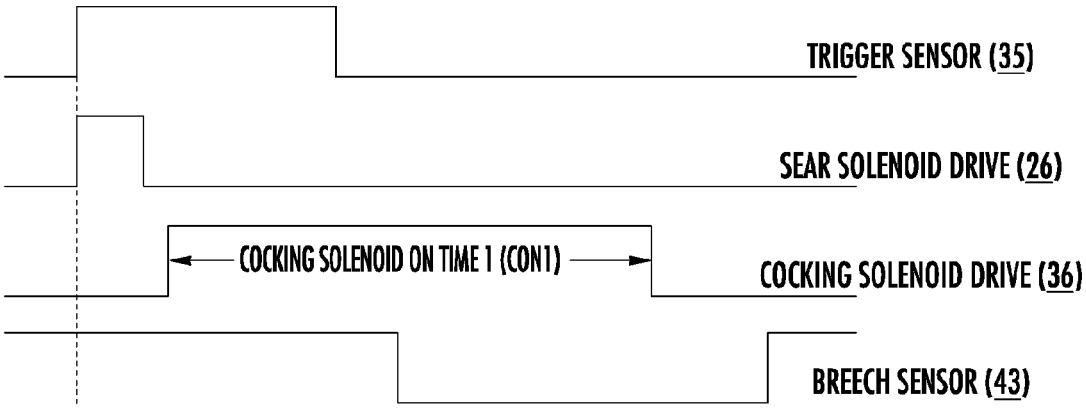

The electronics on the electronic circuit board 24 comprise a microprocessor 50 which operates to control the functions of the paintball marker under the control of a number of control parameters which are stored in the microprocessor 50 and which may be modified through the pushbuttons 12, 13 and 14. The operation of the paintball marker will now be described with additional reference to FIG. 10 which shows a functional block circuit diagram, FIGS. 7–9 which show the paintball marker in its operative positions and FIGS. 11*a* and 11*b* which show timing diagrams. Each timing diagram shows voltage as the ordinate plotted against time on the abscissa for the trigger sensor 35, sear solenoid drive 26, cocking solenoid drive 36 and breech sensor 43. The diagram of FIG. 11*a* shows the position which obtains when a paintball is present in the breech and the diagram of FIG. 11*b* shows the position when there is no paintball present in the breech. In the former case, the cocking solenoid is de-energised when a paintball is sensed and in the latter case the cocking solenoid is de-energised after a predetermined time if no paintball is sensed.

FIG. 7 shows the operative position of the paintball marker prior to the user pulling the trigger 29. When the user pulls the trigger 29, the movement of the trigger 29 is detected by the trigger sensor 35 and a digital signal is passed to the microprocessor 50. The microprocessor 50 then starts the firing cycle by energising the sear solenoid 26 for a short period of time referred to as the sear solenoid on time (SON). This causes the sear 27 to be pivoted and the hammer 40 to be released. The hammer 40 strikes a pin valve and releases a burst of gas, causing the paintball 45 in the breech 2*a* to be propelled from the marker. A short time later after the cocking solenoid on delay (CDEL), the microprocessor 50 energises the cocking solenoid valve 36, which passes compressed gas to one side of a pneumatic cylinder which pushes the hammer 40 back into its rest position whilst retracting the bolt 44 and opening an aperture that allows a second paintball 45 to fall into the breech 2*a* as shown in FIG. 8. Prior to the fall of the second paintball 45 into the breech 2*a,* the breech sensor 43 detects that the bolt 44 has retracted and that the breech is empty and an analogue signal is passed to the microprocessor 50. Some time later a paintball passes through the feed aperture and is detected by the breech sensor 43 as shown in FIG. 9.

The microprocessor 50 de-energises the cocking solenoid valve 36 which returns the bolt 44 to its rest position, closing the aperture and pushing the paintball 45 further into the breech 2*a* as shown in FIG. 7. If no paintball 45 is detected (see FIG. 7) then the microprocessor will de-energise the cocking solenoid valve 36 after a predefined time referred to as the cocking solenoid on time 1 (CON1). The breech sensor 43 detects that the bolt 44 is closed and, a short time later, the firing cycle is completed and can be restarted with another trigger pull.

As mentioned above, the way in which the marker operates is defined by number of control parameters which are stored within the microprocessor 50. The user can modify these control parameters by means of the pushbuttons 12, 13, 14 and the LED display 16. Each control parameter is accessed through a series of menus and FIG. 10 shows one possible menu layout. This comprises a main menu 60 and a number of subsidiary menus 61, 62, 63. To scroll down through the options on each menu, the user presses the lower pushbutton 14. To scroll up through the options the user presses the upper pushbutton 12. To select an option the user presses the centre pushbutton 13. Each subsidiary menu comprise a BACK option. Selecting the BACK option from any menu takes the user back to the previous menu. Once a control parameter is selected then the current value of that control parameter is displayed. Pressing either of the upper or lower pushbuttons at this time takes the user back to the menu from which the control parameter was selected, whereas pressing the centre pushbutton 13 causes the value to flash. When flashing, the parameter can be incremented by pressing the upper pushbutton 12 or decremented by pressing the lower pushbutton 14. Pressing the centre pushbutton sets the control parameter to the displayed value and the value stops flashing.

Figure 12:
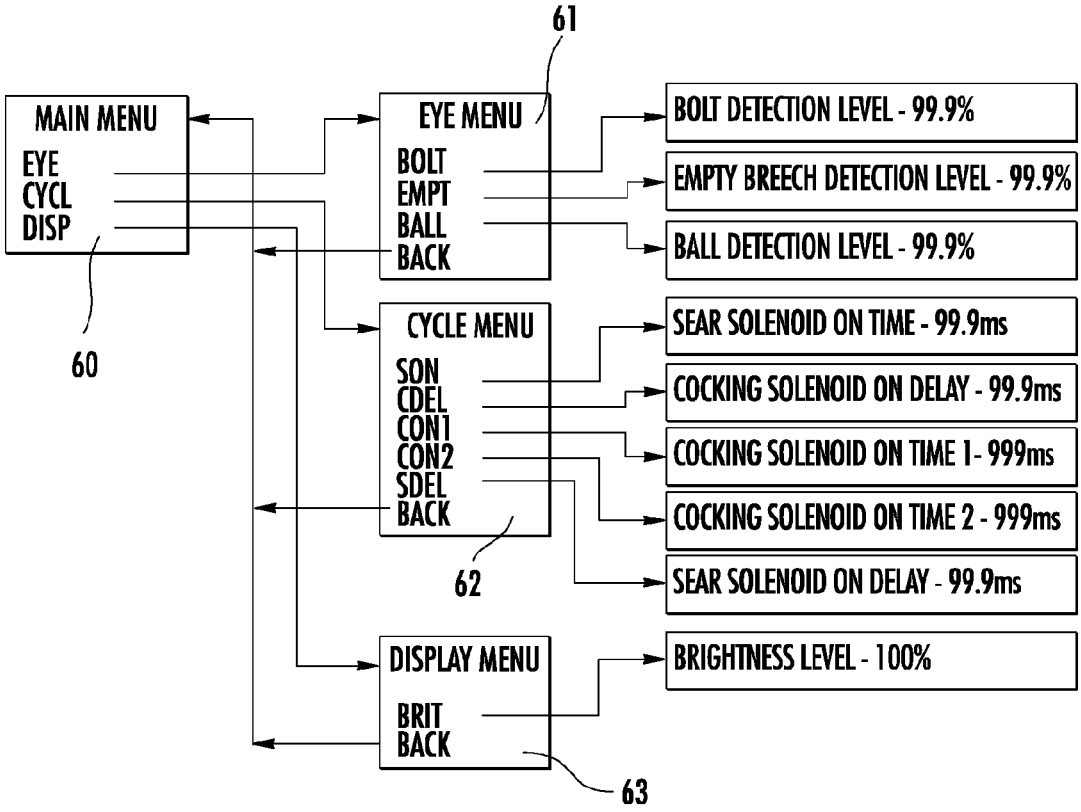
FIG. 12 illustrates one possible menu layout for the user interface for the grip frame of FIG. 2.

In the exemplary menu of FIG. 12, main menu 60 provides three selectable subsidiary menu options 61, 62 and 63 respectively designated Eye Menu, Cycle Menu and Display Menu. The Eye menu 61 provides three selectable options in addition to the back option which enable the bolt detection level, empty breech detection level and ball detection level to be calibrated. Detection is optical and optical characteristics can vary from paintball marker to paintball marker causing variation in generated signal levels. Calibration takes account of these variations.

The Cycle menu 62 provides five selectable options in addition to the back option. They are the sear solenoid on time, cocking solenoid on delay, cocking solenoid on time 1, which have already been referred to earlier in the description of the operation of the sear and cocking solenoids 26 and 36, and cocking solenoid on time 2 and sear solenoid on delay which relate to an operating mode where the breech sensor is switched off. The Display menu 63 enables the brightness level of the display 16 to be altered to suit personal requirements.

It will be appreciated that the above embodiment has been described by way of example only and that many variations are possible without departing from the scope of the invention. For example, the paintball marker may be operated in other modes than those described.

The invention claimed is:

1. An electronic grip frame for a paintball marker, comprising:

a frame;

a trigger, having a front side and a rear side, movably connected to the frame; the trigger being rotatable about a pivot axis;

a prong connected to an emanating rearwardly away from the rear side of the trigger;

a light emitter mounted to the frame and being capable of emitting light;

a light detector mounted to the frame and positioned in parallel spaced apart relationship to the light emitter defining a elongated passage therebetween having a longitudinal centerline; the light detector being capable of detecting light emitted from the light emitter transversely through the elongated passage;

the prong being movable along the longitudinal centerline between a depressed firing position between the light emitter and the light detector and a released non-firing position not between the light emitter and the light detector; the light emitter and light detector forming an optical sensor; the prong being movable along the longitudinal centerline upon rotation of the trigger about the pivot axis; and an electrical output connected to the optical sensor; the electrical output being capable of generating a first electrical signal indicative of the trigger at the released non-firing position where light from the light emitter is directly detected by the light detector and a second electrical signal indicative of the trigger at the depressed firing position where the presence of the prong in the elongated passage prevents light from the light emitter from directly being detected by the light detector.

2. The electronic grip frame of claim 1, further comprising:

a first adjustable stop connected to the trigger to limit positioning of the trigger relative to the frame when the trigger is in the resting position.

3. The electronic grip frame of claim 1, further comprising:

a second adjustable stop connected to the trigger to limit positioning of the trigger relative to the frame when the trigger is in the firing position.

4. The electronic grip frame of claim 1, further comprising:

means for biasing the trigger into the resting position.

5. The electronic grip frame of claim 4, wherein the means for biasing is a ferrous set screw mounted in the trigger and a magnet attached to the frame at a location aligned with the ferrous set screw.

6. The electronic grip frame of claim 1, wherein the frame and trigger are made of metal.

7. The electronic grip frame of claim 1, further comprising:

a microprocessor electrically connected to the electrical output of the non-contact sensor;

a sear solenoid electrically connected to the microprocessor;

a hammer mechanically connected to the sear solenoid;

a pin valve mechanically connected to the hammer; and a source of gas fluidly connected to the pin valve.

* * * * *